US007286140B2

(12) United States Patent
Butcher

(10) Patent No.: US 7,286,140 B2
(45) Date of Patent: Oct. 23, 2007

(54) HARDWARE ACCELERATION OF DISPLAY DATA CLIPPING

(75) Inventor: Lawrence L. Butcher, Mountain View, CA (US)

(73) Assignee: Sun Microsystems, Inc., Santa Clara, CA (US)

( * ) Notice: Subject to any disclaimer, the term of this patent is extended or adjusted under 35 U.S.C. 154(b) by 308 days.

(21) Appl. No.: 10/206,314

(22) Filed: Jul. 26, 2002

(65) Prior Publication Data

US 2004/0017382 A1 Jan. 29, 2004

(51) Int. Cl.
*G09G 5/00* (2006.01)

(52) U.S. Cl. ..... 345/626; 345/625; 345/620

(58) Field of Classification Search ..... 345/620–628
See application file for complete search history.

(56) References Cited

U.S. PATENT DOCUMENTS 5,060,280 A * 10/1991 Mita et al. ..... 382/283
5,488,687 A * 1/1996 Rich ..... 345/563
5,515,494 A * 5/1996 Lentz ..... 715/797
5,905,500 A * 5/1999 Kamen et al. ..... 345/419
6,252,989 B1 * 6/2001 Geisler et al. ..... 382/232
2002/0038323 A1 * 3/2002 Hara et al. ..... 707/528
2003/0043191 A1 * 3/2003 Tinsley et al. ..... 345/762
2003/0184561 A1 * 10/2003 Vorst ..... 345/619

* cited by examiner

*Primary Examiner*—Ulka Chauhan
*Assistant Examiner*—Eric Woods
(74) *Attorney, Agent, or Firm*—Martine Penilla & Gencarella, LLP

(57) ABSTRACT

Embodiments of the present invention are directed to a method and apparatus for hardware acceleration of display data clipping. In one embodiment, all display data is presented to the display system. The display system uses its hardware to clip the undesired data and display the desired data. In one embodiment, the display system has one or more clipping registers. As display data arrives from each source, the information's display location is classified by all the clipping registers. Only pixels which are calculated to be visible by the clipping registers is written to memory for later display. In one embodiment, the display system has an extra amount of memory, termed "display mask memory." In one embodiment, there is a corresponding data location in the display mask memory for each pixel in the display memory. In one embodiment, the display system has another set of memory, termed "low-resolution display mask memory." In yet another embodiment, the display data is presented to the display system from a server located away from the display system. The display data is presented via a network.

19 Claims, 18 Drawing Sheets

HARDWARE ACCELERATION OF DISPLAY DATA CLIPPING

BACKGROUND OF THE INVENTION

1. Field of the Invention

The present invention relates to the field of computer displays, and in particular to a method and apparatus for hardware acceleration of display data clipping.

Sun, Sun Microsystems, the Sun logo, Solaris and Java are trademarks or registered trademarks of Sun Microsystems, Inc. in the United States and other countries.

2. Background Art

In a computer system, a computer may receive data to present to the user using a display device (e.g., a monitor) from multiple sources. For example, a video window with streaming video may be supplied by one source, and a text window may be supplied by another source. The source may be located at the computer attached to the display device, or it may be located at another computer. Typically, in a thin client architecture, display information source are not located at the terminal attached to the display device.

In some instances, the regions of display for two sources may overlap. Display data for the covered portions of the video window must be discarded, or clipped, rather than displayed. In prior art solutions, software systems are used to clip unneeded display data. However, software clipping is slow and inefficient. This problem can be better understood with a discussion of display systems in a multi-tier application architecture.

Mufti-Tier Application Architecture

In the mufti-tier application architecture, a client communicates requests to a server for data, software and services, for example, and the server responds to the requests. The server's response may entail communication with a database management system for the storage and retrieval of data.

The mufti-tier architecture includes at least a database tier that includes a database server, an application tier that includes an application server and application logic (i.e., software application programs, functions, etc.), and a client tier. The data base server responds to application requests received from the client. The application server forwards data requests to the database server.

FIG. 1 provides an overview of a mufti-tier architecture. Client tier 100 typically consists of a computer system that provides a graphic user interface (GUI) generated by a client 110, such as a browser or other user interface application. Conventional browsers include Internet Explorer and Netscape Navigator, among others. Client 110 generates a display from, for example, a specification of GUI elements (e.g., a file containing input, form, and text elements defined using the Hypertext Markup Language (HTML)) and/or from an applet (i.e., a program such as a program written using the Java™ programming language, or other platform independent programming language, that runs when it is loaded by the browser).

Further application functionality is provided by application logic managed by application server 120 in application tier 130. The apportionment of application functionality between client tier 100 and application tier 130 is dependent upon whether a "thin client" or "thick client" topology is desired. In a thin client topology, the client tier (i.e., the end user's computer) is used primarily to display output and obtain input, while the computing takes place in other tiers (i.e., away from the thin client). A thick client topology, on the other hand, uses a more conventional general purpose computer having processing, memory, and data storage abilities. Database tier 140 contains the data that is accessed by the application logic in application tier 130. Database server 150 manages the data, its structure and the operations that can be performed on the data and/or its structure.

Application server 120 can include applications such as a corporation's scheduling, accounting, personnel and payroll applications, for example. Application server 120 manages requests for the applications that are stored therein. Application server 120 can also manage the storage and dissemination of production versions of application logic. Database server 150 manages the database(s) that manage data for applications. Database server 150 responds to requests to access the scheduling, accounting, personnel and payroll applications' data, for example.

Connection 160 is used to transmit data between client tier 100 and application tier 130, and may also be used to transfer the application logic to client tier 100. The client tier can communicate with the application tier via, for example, a Remote Method Invocator (RMI) application programming interface (API) available from Sun Microsystems™. The RMI API provides the ability to invoke methods, or software modules, that reside on another computer system. Parameters are packaged and unpackaged for transmittal to and from the client tier. Connection 170 between application server 120 and database server 150 represents the transmission of requests for data and the responses to such requests from applications that reside in application server 120.

Elements of the client tier, application tier and database tier (e.g., client 110, application server 120 and database server 150) may execute within a single computer. However, in a typical system, elements of the client tier, application tier and database tier may execute within separate computers interconnected over a network such as a LAN (local area network) or WAN (wide area network).

Display Systems

Display systems in the multi-tier application architecture are used to arrange display information for presentation to a user on a display device (e.g., a monitor) in the client tier 100. Typically, a display system comprises a display memory and a display controller. The display memory is typically dynamic random access memory (DRAM) and contains pixel color information for each pixel of the display device. The display controller updates the data in the display memory and retrieves data from the display memory to send to the display device.

Frequently, the desired display areas of two display data sources overlap. For example, video data may be transmitted to a client terminal from two different data sources in a thin client architecture and the windows displaying the video data may be overlapping. Since both windows cannot write to the display memory for the overlapping pixels, the video information for the overlapping area of the rear window must be clipped. Furthermore, any portions of the video window which is off the screen must be clipped.

Clipping is typically performed by software. The software saves the desired display data and discards the rest. Then, only the desired display data is passed on to the display system for eventual display. In some systems, the clipping software runs on a different computer from the computer (of the client tier 100) directly attached to the display system.

Clipping in Thin Client Architectures

In some prior art thin client architecture systems, display data is clipped using software before it is transmitted to the client terminal. However, this approach is difficult and inefficient to coordinate when display data is transmitted from separate source locations. The approach encounters additional problems when display data is being multicast to many client terminals. The clipping may be different for each client terminal receiving the display data, so it is inefficient for the data source to perform clipping before transmitting the data to each client terminal.

SUMMARY OF THE INVENTION

Embodiments of the present invention are directed to a method and apparatus for hardware acceleration of display data clipping. In one embodiment of the present invention, all display data is presented to the display system. The display system uses its hardware to clip the undesired data and display the desired data. In one embodiment, the display system has one or more clipping registers. As display data arrives from each source, the information's display location is classified by all the clipping registers. Only pixels which are calculated to be visible by the clipping registers is written to memory for later display.

In one embodiment, the display data is presented to the display system from a server. The server is physically located away from the display system. The display data is presented to the display system via a network. The network may comprise a LAN (local area network) or WAN (wide area network). In another embodiment, the display system is located within a thin client. The clipping hardware is located within the display system.

In one embodiment, the display system has an extra amount of memory, termed "display mask memory." In one embodiment, the display mask memory is located on a graphics processor chip. Since the display mask memory is separate from the display memory, both memories are accessible in parallel.

In another embodiment, the display mask memory is part of the display memory. A physical region of the display memory may be reserved for the display mask memory usage. Confining the display mask memory to a specific physical region of the display memory helps in efficiently writing and retrieving data from the display memory. In yet another embodiment, the display mask memory is located in another memory chip. Since the display mask memory is separate from the display memory, both memories are accessible in parallel.

In one embodiment, a set of commands are provided to manipulate the display mask memory. In one embodiment, there is a command to write to individual data locations in the display mask memory. In another embodiment, there is a command to read from individual data locations in the display mask memory. In yet another embodiment, there is a command to fill a block of data locations in the display mask memory with a constant. Other embodiments have other display mask memory manipulation commands.

In one embodiment, there is a corresponding data location in the display mask memory for each pixel in the display memory. Different embodiments have a different number of bits of memory, n, for each data location in the display mask memory. As a result, there are two to the nth power different available display contexts representable in each data location. In one embodiment, there are three bit of memory for each data location, resulting in eight display contexts.

In one embodiment, commands issued to the display system contain a context indicator to indicate within which display context the command should be executed. When a command contains display information for a pixel, the display context for the pixel stored in the display mask memory is compared to the context indicator of the command. If the display context is equal to the context indicator, the command is executed for the pixel. If the display context is not equal to the context indicator, the display information for the pixel is clipped. In some instances, the entire command may be clipped, and the display memory remains unchanged.

In one embodiment, the display system has another set of memory, termed "low-resolution display mask memory." Each data location in the low-resolution display mask memory corresponds with more than one pixel location in display memory. In one embodiment, each location in low-resolution display mask memory corresponds with rectangular blocks of pixels in display memory. In one embodiment, the rectangular blocks are 4 pixel by 4 pixel regions. In another embodiment, the rectangular blocks are 16 pixel strips of pixels.

In one embodiment, each data location in low-resolution display mask memory has a number of bits equal to the number of display contexts possible in the display mask memory. If at least one of the pixels of the display memory covered by the low-resolution display mask memory data location is in a display context, the bit in that low-resolution display mask memory data location corresponding to that display context is set equal to 1.

When a display command is issued, the context indicator is used to determine whether any pixel in the region covered by a low-resolution display mask memory data location has the same display context at the display command. If the bit corresponding to the display context is 0, no pixel in the region has the same display context as the display command. Thus, all of the pixels of the region are clipped from the display command.

If the bit corresponding to the display context is 1, at least one pixel in the region has the same display context as the display command. Thus, the display mask memory must be examined to determine whether the command is executed or clipped for each pixel in the region.

In one embodiment, a set of commands are provided to manipulate the low-resolution display mask memory. In one embodiment, there is a command to write to individual data locations in the low-resolution display mask memory. In another embodiment, there is a command to read from individual data locations in the low-resolution display mask memory. In yet another embodiment, there is a command to set a bit for each location in a block of data locations in the low-resolution display mask memory to a constant. Other embodiments have other low-resolution display mask memory manipulation commands.

In one embodiment, more than one low-resolution mask memories are used. Each low-resolution mask memory has a different resolution level. For example, in one embodiment, the number of pixels in the display memory covered by a single location in the first low-resolution mask memory, second low-resolution mask memory and third low-resolution mask memory are 16, 64 and 256, respectively. In one embodiment, every pixel in the display memory is covered by a single location in a low-resolution mask memory.

BRIEF DESCRIPTION OF THE DRAWINGS

These and other features, aspects and advantages of the present invention will become better understood with regard to the following description, appended claims and accompanying drawings where:

DETAILED DESCRIPTION OF THE INVENTION

The invention is a method and apparatus for hardware acceleration of display data clipping. In the following description, numerous specific details are set forth to provide a more thorough description of embodiments of the invention. It is apparent, however, to one skilled in the art, that the invention may be practiced without these specific details. In other instances, well known features have not been described in detail so as not to obscure the invention.

Hardware Clipping in Display System

In one embodiment of the present invention, all display data is presented to the display system. The display system uses its hardware to clip the undesired data and display the desired data. Since clipping is performed by the display system hardware, clipping is much faster. Additionally, display data may more easily be broadcast to multiple display systems. All of the display data (e.g., a video stream broadcast) is broadcast to each display system, and the hardware of each display system clips the display data as needed in accordance with the environment of the display system.

In one embodiment, the display data is presented to the display system from a server. The server is physically located away from the display system. The display data is presented to the display system via a network. The network may comprise a LAN (local area network) or WAN (wide area network). In another embodiment, the display system is located within a thin client. The clipping hardware is located within the display system. In a further embodiment, the raw display data is first obtained by an input device on the thin client. The raw display data is then transmitted to the server for computational processing. The computed display data is then sent to the display system The display system hardware then clips the computed data as needed in accordance with the environment of the display system.

Figure 1:
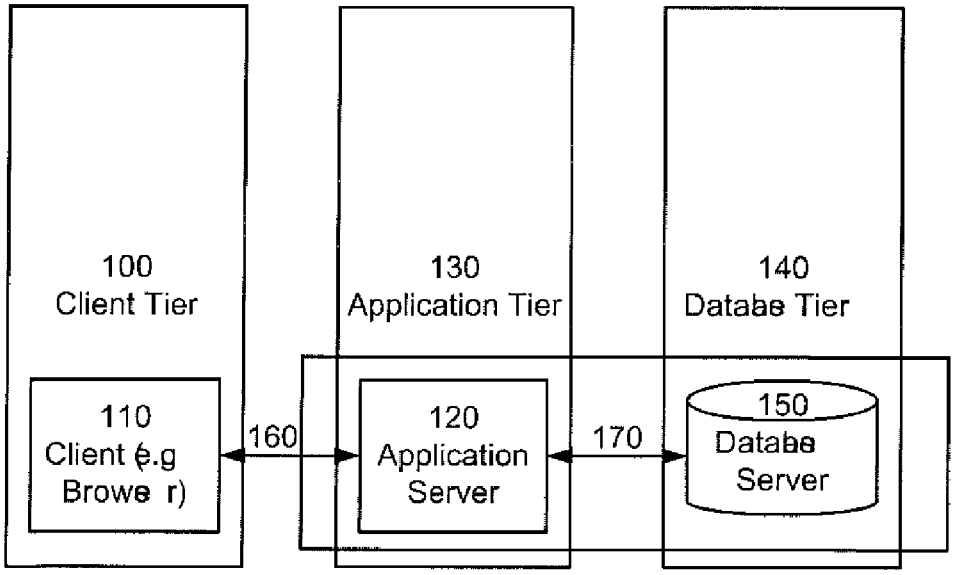
FIG. 1 is a block diagram of a multi-tier architecture.
Figure 2:
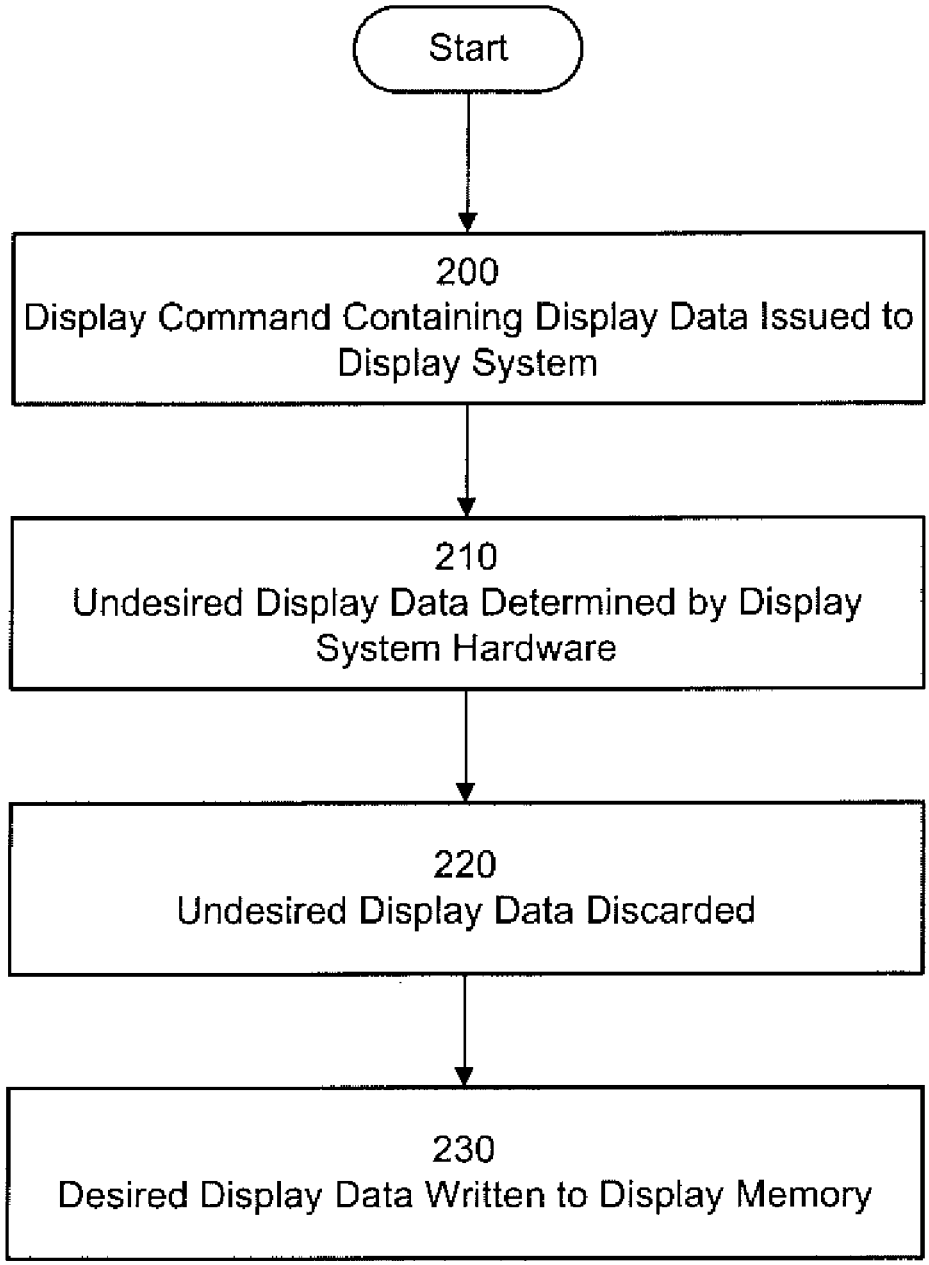
FIG. 2 is a flow diagram of the process of display data clipping in accordance with one embodiment of the present invention.

FIG. 2 illustrates the process of display data clipping in accordance with one embodiment of the present invention. At block 200, a display command containing display data is issued to the display system. At block 210, the undesired display data is determined by the display system hardware. At block 220, the undesired display data is discarded. At block 230, the desired display data is written to the display memory.

Clipping Registers

In one embodiment, the display system has one or more clipping registers. As display data arrives from each source, the information's display location is classified by all the clipping registers. Only pixels which are calculated to be visible by the clipping registers is written to memory for later display.

Figure 3:
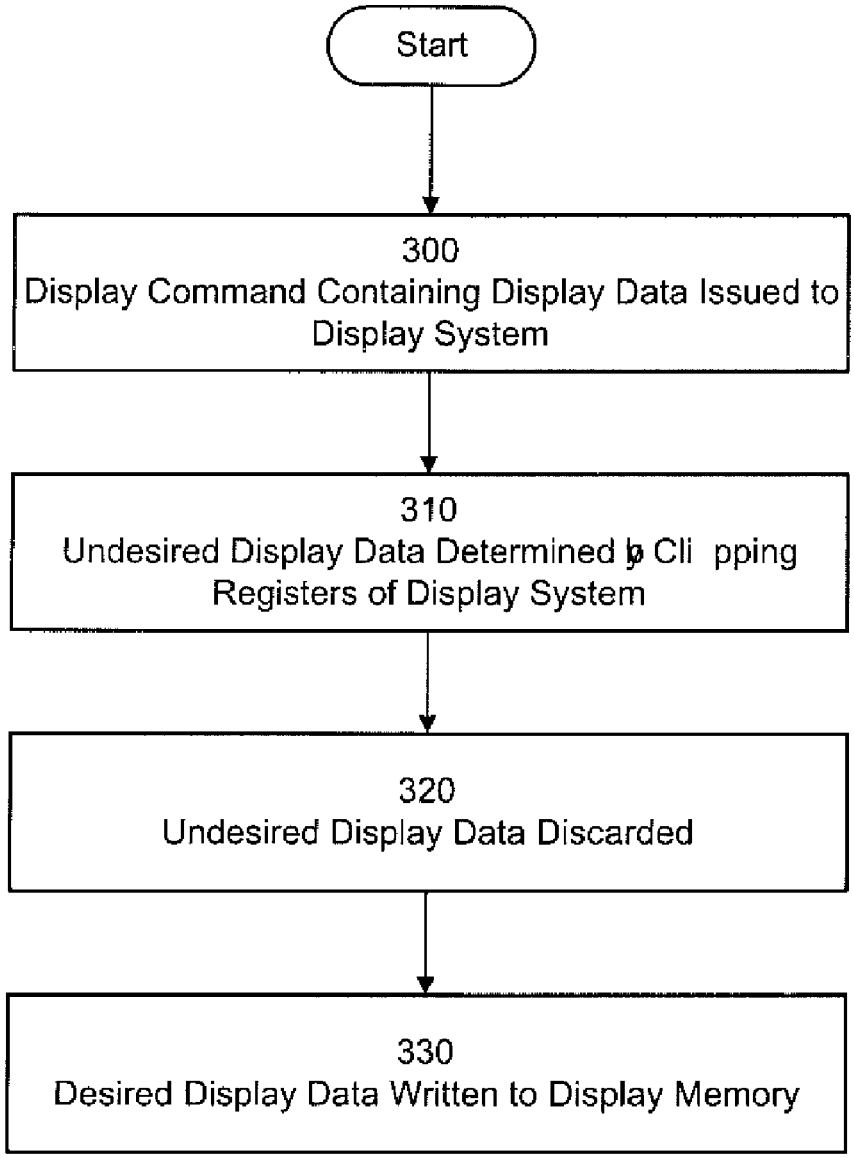
FIG. 3 is a flow diagram of the process of display data clipping using clipping registers in accordance with one embodiment of the present invention.

FIG. 3 illustrates the process of display data clipping using clipping registers in accordance with one embodiment of the present invention. At block 300, a display command containing display data is issued to the display system. At block 310, the undesired display data is determined by the clipping registers of the display system. At block 320, the undesired display data is discarded. At block 330, the desired display data is written to the display memory.

Display Mask Memory

In one embodiment, the display system has an extra amount of memory, termed "display mask memory." In one embodiment, the display mask memory is located on a graphics processor chip. Since the display mask memory is separate from the display memory, both memories are accessible in parallel.

Figure 4:
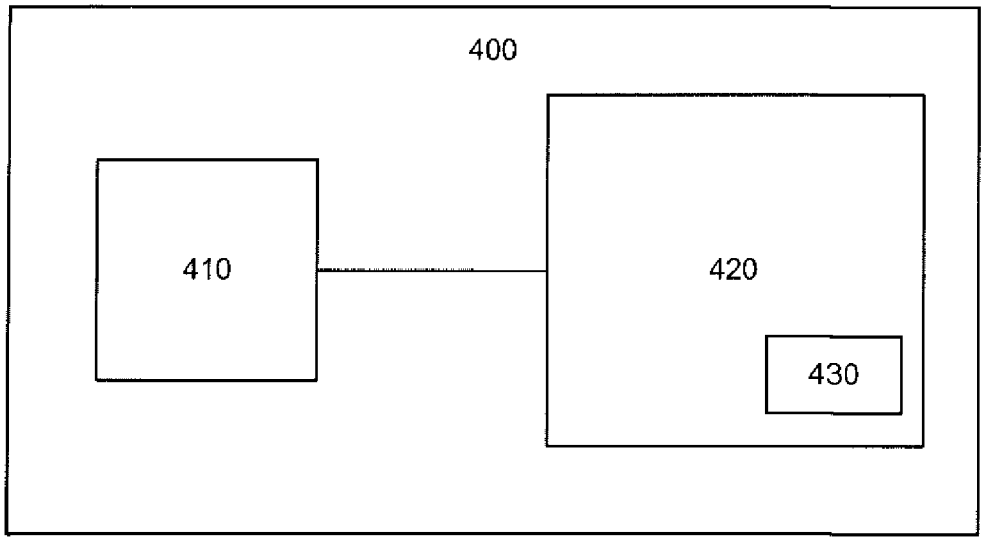
FIG. 4 is a block diagram of a display system in accordance with one embodiment of the present invention.

FIG. 4 illustrates a display system in accordance with one embodiment of the present invention. The display system 400 has a display memory 410 coupled to a graphics processor chip 420. The graphics processor chip has a display mask memory 430. Having the display mask memory on the graphics processor chip allows the graphics processor chip to quickly access the display mask memory at the same time it accesses the display memory.

In another embodiment, the display mask memory is part of the display memory. A physical region of the display memory may be reserved for the display mask memory usage. Confining the display mask memory to a specific physical region of the display memory helps in efficiently writing and retrieving data from the display memory.

Figure 5:
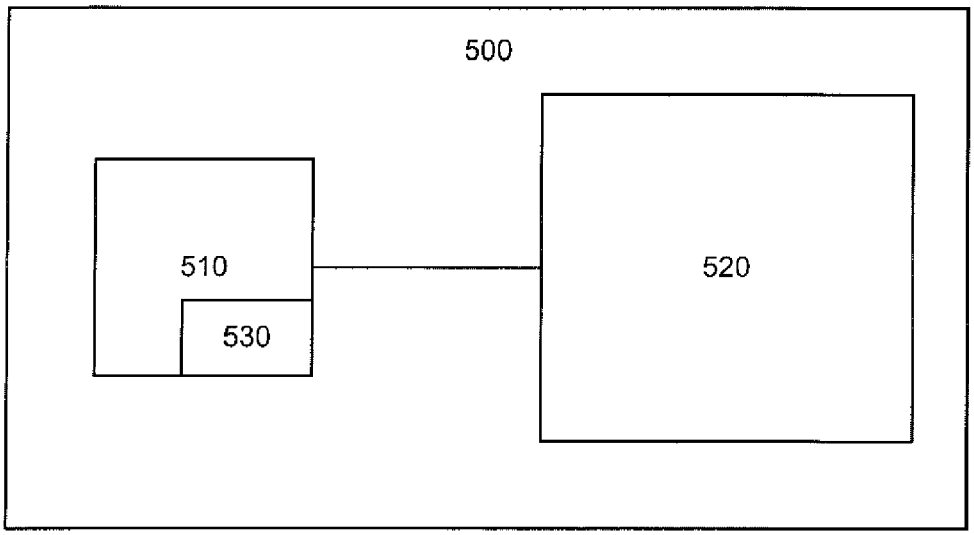
FIG. 5 is a block diagram of a display system in accordance with one embodiment of the present invention.

FIG. 5 illustrates a display system in accordance with one embodiment of the present invention. The display system 500 has a display memory 510 coupled to a graphics processor chip 520. The display memory has an area reserved for a display mask memory 530. Since the location of the display mask memory is known, only the space reserved for display mask memory need be scanned to access the display mask memory. Similarly, the area occupied by the display mask memory is not scanned when accessing display memory.

Figure 6:
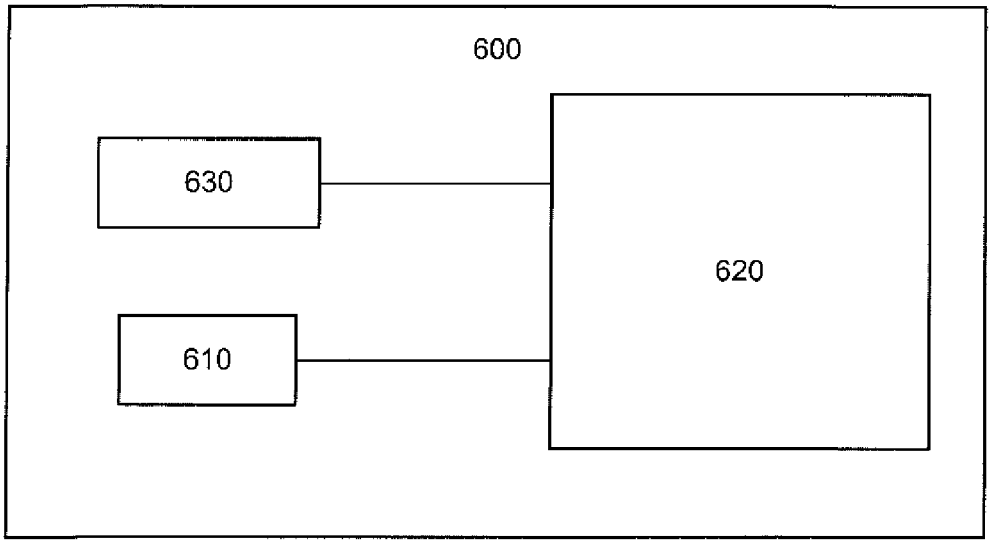
FIG. 6 is a block diagram of a display system in accordance with one embodiment of the present invention.

In yet another embodiment, the display mask memory is located in another memory chip. Since the display mask memory is separate from the display memory, both memories are accessible in parallel. FIG. 6 illustrates a display system in accordance with one embodiment of the present invention. The display system 600 has a display memory 610 coupled to a graphics processor chip 620. The graphics processor chip is also coupled to a display mask memory 630. The graphics processor chip is able to access the display mask memory at the same time it accesses the display memory.

In one embodiment, a set of commands are provided to manipulate the display mask memory. In one embodiment, there is a command to write to individual data locations in the display mask memory. In another embodiment, there is a command to read from individual data locations in the display mask memory. In yet another embodiment, there is a command to fill a block of data locations in the display mask memory with a constant. Other embodiments have other display mask memory manipulation commands.

Figure 7:
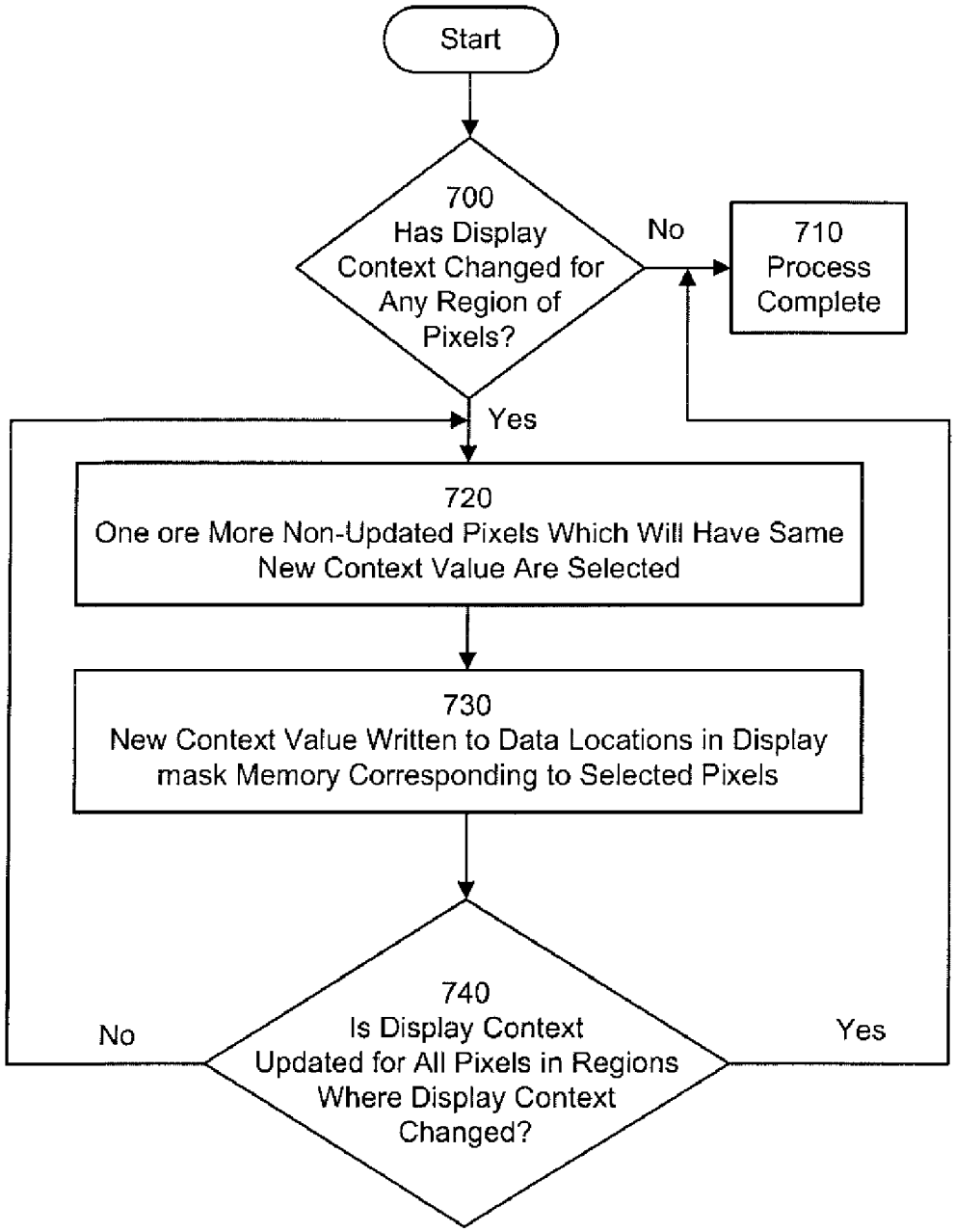
FIG. 7 is a flow diagram of the process of manipulating the display mask memory in accordance with one embodiment of the present invention.

FIG. 7 illustrates the process of manipulating the display mask memory in accordance with one embodiment of the present invention. At block 700, it is determined whether the display context has changed for any region of pixels. If the display context has not changed for any region of pixels, at block 710 the process is complete. If the display context has changed for some region of pixels, at block 720, one or more non-updated pixels which will have the same new context value are selected. At block 730, the new context value is written to the data locations in display mask memory corresponding to the selected pixels.

At block 740, it is determined whether the display context is updated for all pixels in regions where the display context was changed. If the display context is updated for all pixels in regions where the display context was changed, the process continues at block 710. If the display context is not updated for all pixels in regions where the display context was changed, the process repeats at block 720.

In one embodiment, there is a corresponding data location in the display mask memory for each pixel in the display memory. Different embodiments have a different number of bits of memory, n, for each data location in the display mask memory. As a result, there are two to the nth power different available display contexts representable in each data location. In one embodiment, there are three bits of memory for each data location, resulting in eight display contexts.

Figure 8:
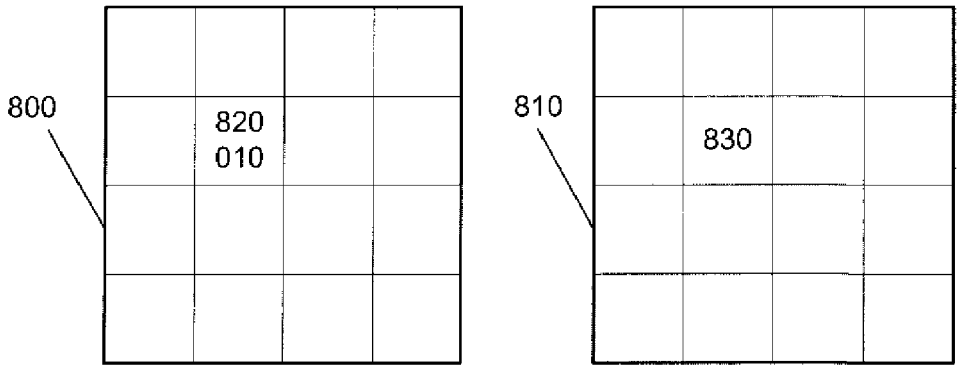
FIG. 8 is a block diagram of a display memory mask in accordance with one embodiment of the present invention.

FIG. 8 illustrates a display memory mask in accordance with one embodiment of the present invention. The display memory mask 800 has 16 data locations that correspond to the 16 pixels in the display memory 810. Data location 820 corresponds to pixel 830. Each data location of the display memory mask has 3 bits of memory. If each location in display memory has 24 bits of color information, the display mask memory is significantly smaller than the display memory. The three bits of storage for data location 820 are 010. Thus, 010 is the display context for pixel 830.

Before a command is executed for pixel 830, it is determined whether the display context of a command is also 010. If the display context of the command is not 010, the command is not executed. For example, if two video windows overlap at pixel 830, both will send display data to the display system for pixel 830. However, the display data for pixel 830 should be clipped for at least one of the video windows. If another window also overlaps pixel 830, it may be the case that the display data for pixel 830 from both video windows should be clipped. Only one of the sets of display data that overlap at pixel 830 will have display context 010. Thus, only display data with a display context of 010 is written to the pixel and the competing display data is clipped.

In one embodiment, commands issued to the display system contain a context indicator to indicate within which display context the command should be executed. When a command contains display information for a pixel, the display context for the pixel stored in the display mask memory is compared to the context indicator of the command. If the display context is equal to the context indicator, the command is executed for the pixel. If the display context is not equal to the context indicator, the display information for the pixel is clipped. In some instances, the entire command may be clipped, and the display memory remains unchanged.

Figure 9:
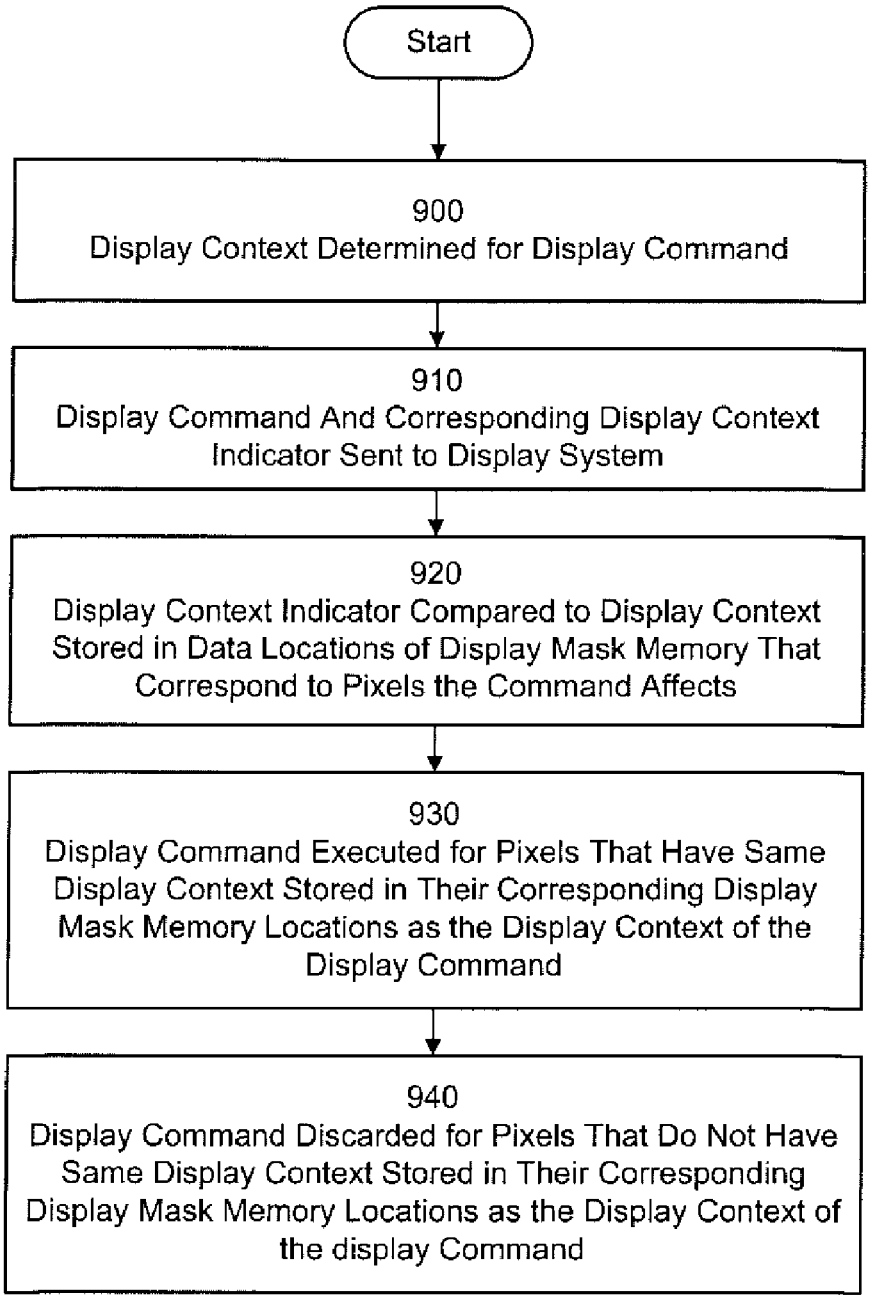
FIG. 9 is a flow diagram of the execution of display commands in accordance with one embodiment of the present invention.

FIG. 9 illustrates the execution of display commands in accordance with one embodiment of the present invention. At block 900, a display context is determined for a display command. At block 910, the display command and a corresponding display context indicator are sent to the display system. At block 920, the display context indicator is compared to the display context stored in the data locations of the display mask memory that correspond to the pixels the command affects.

At block 930, the display command is executed for pixels that have the same display context stored in their corresponding display mask memory locations as the display context of the display command. At block 940, the display command is discarded for pixels that do not have the same display context stored in their corresponding display mask memory locations as the display context of the display command.

Low-Resolution Display Mask Memory

In one embodiment, the display system has another set of memory, termed "low-resolution display mask memory." Each data location in the low-resolution display mask memory corresponds with more than one pixel location in display memory. In one embodiment, each location in low-resolution display mask memory corresponds with rectangular blocks of pixels in display memory. In one embodiment, the rectangular blocks are 4 pixel by 4 pixel regions. In another embodiment, the rectangular blocks are 16 pixel strips of pixels.

Figure 10:
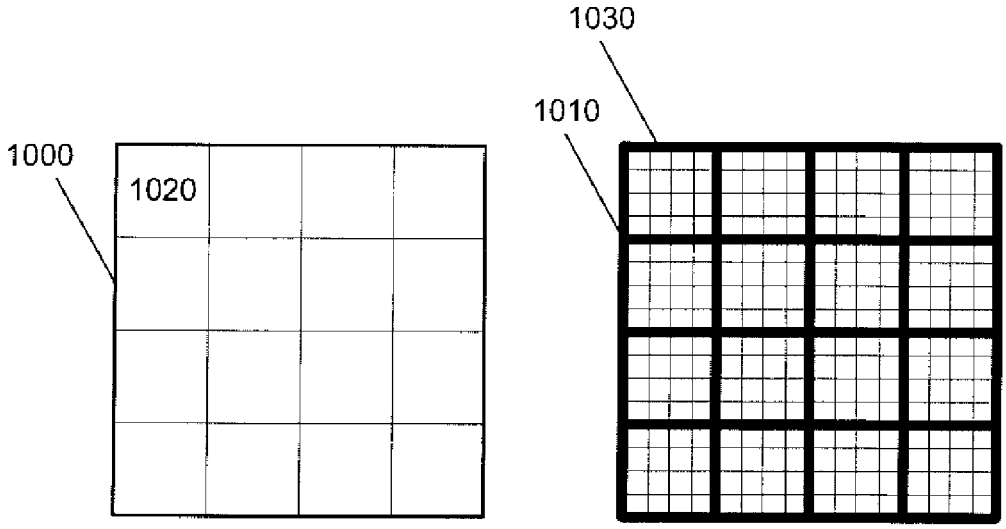
FIG. 10 is a block diagram of a low-resolution display mask memory in accordance with one embodiment of the present invention.

FIG. 10 illustrates a low-resolution display mask memory in accordance with one embodiment of the present invention. The low-resolution display mask memory 1000 has 16 data locations. Each data location in the low-resolution display mask memory corresponds to a 4 pixel by 4 pixel block of pixels in the display memory 1010. For example, data location 1020 in the low-resolution display mask memory corresponds to 4 pixel by 4 pixel block of pixels 1030.

In one embodiment, each data location in low-resolution display mask memory has a number of bits equal to the number of display contexts possible in the display mask memory. If at least one of the pixels of the display memory covered by the low-resolution display mask memory data location is in a display context, the bit in that low-resolution display mask memory data location corresponding to that display context is set equal to 1.

In another embodiment, each bit in the low-resolution mask memory corresponds to 2 display contexts. In other embodiments, each bit corresponds to other numbers of display contexts. If the bit is set, then it is possible that there is data to be written to graphics memory for that context. The display mask memory is checked for each pixel to be written to see if the context matches. If the context matches, the value is written. A higher number of display contexts represented by each bit results in a smaller low-resolution memory mask. The trade-off for having a smaller low-resolution memory mask is that more lookups in the display mask memory are performed. Various embodiments will balance this trade-off differently depending on implementation needs.

Figure 11:
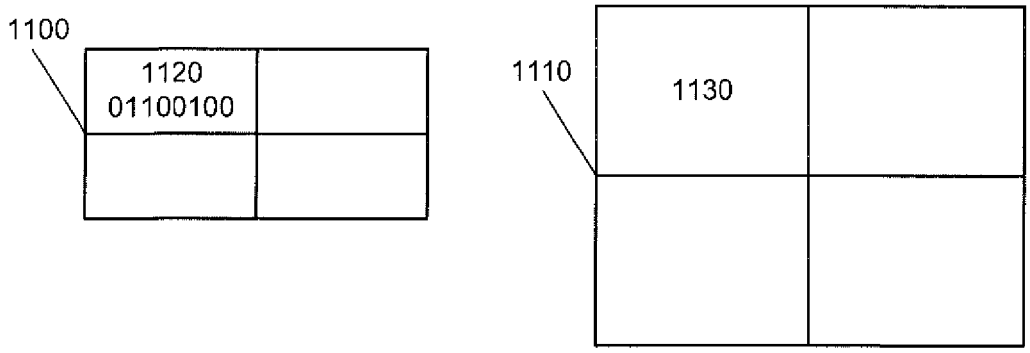
FIG. 11 is a block diagram of a low-resolution display mask memory in accordance with one embodiment of the present invention.

FIG. 11 illustrates a low-resolution display mask memory in accordance with one embodiment of the present invention. The low-resolution display mask memory 1100 has 4 data locations. Each data location in the low-resolution display mask memory corresponds to a 320 pixel by 240 pixel block of pixels in the display memory 1110. For example, data location 1120 in the low-resolution display mask memory corresponds to 320 pixel by 240 pixel block of pixels 1130. Eight display contexts are available. Each data location in the low-resolution display mask memory has 8 bits of memory, and each bit corresponds to one of the display contexts.

When a display command is issued, the context indicator is used to determine whether any pixel in the region covered by a low-resolution display mask memory data location has the same display context at the display command. If the bit corresponding to the display context is 0, no pixel in the region has the same display context as the display command. Thus, all of the pixels of the region are clipped from the display command.

If the bit corresponding to the display context is 1, at least one pixel in the region has the same display context as the display command. Thus, the display mask memory must be examined to determine whether the command is executed or clipped for each pixel in the region.

Data location 1120 has 01100100 stored in the bits of its memory. Thus, the pixels in the region covered by data location 1120 are either of the display context corresponded to by the second, third or sixth bits of memory. Any command that is not in one of those three contexts will not be executed on the pixels in this region and can be clipped. However, if a command is in one of those three contexts, at least one pixel in the region shares that context. Thus, the display system must examine a smaller region to determine where the command can be clipped and where the command is executed. In one embodiment, the display system examines the display mask memory to make this determination.

In one embodiment, a set of commands are provided to manipulate the low-resolution display mask memory. In one embodiment, there is a command to write to individual data locations in the low-resolution display mask memory. In another embodiment, there is a command to read from individual data locations in the low-resolution display mask memory. In yet another embodiment, there is a command to set a bit for each location in a block of data locations in the low-resolution display mask memory to a constant. Other embodiments have other low-resolution display mask memory manipulation commands.

Figure 12:
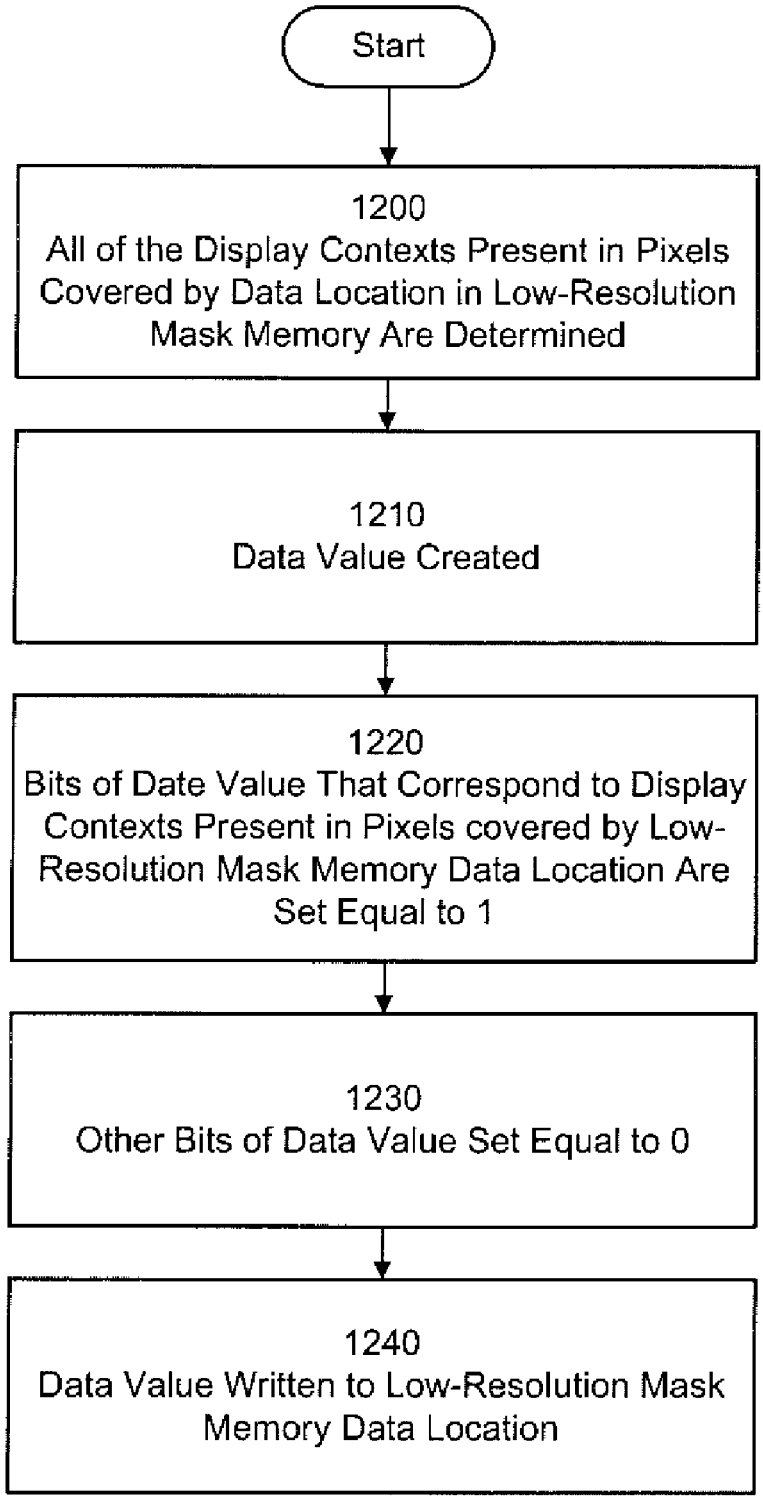
FIG. 12 is a flow diagram of the manipulation of low-resolution mask memory in accordance with one embodiment of the present invention.

FIG. 12 illustrates manipulation of low-resolution mask memory in accordance with one embodiment of the present invention. At block 1200, all of the display contexts present in the pixels covered by a data location in the low-resolution mask memory are determined. At block 1210, a data value is created. At block 1220, the bits of the data value that correspond to display contexts present in the pixels covered by the low-resolution mask memory data location are set equal to 1. At block 1230, the other bits of the data value are set equal to 0. At block 1240, the data value is written to the low-resolution mask memory data location.

Figure 13:
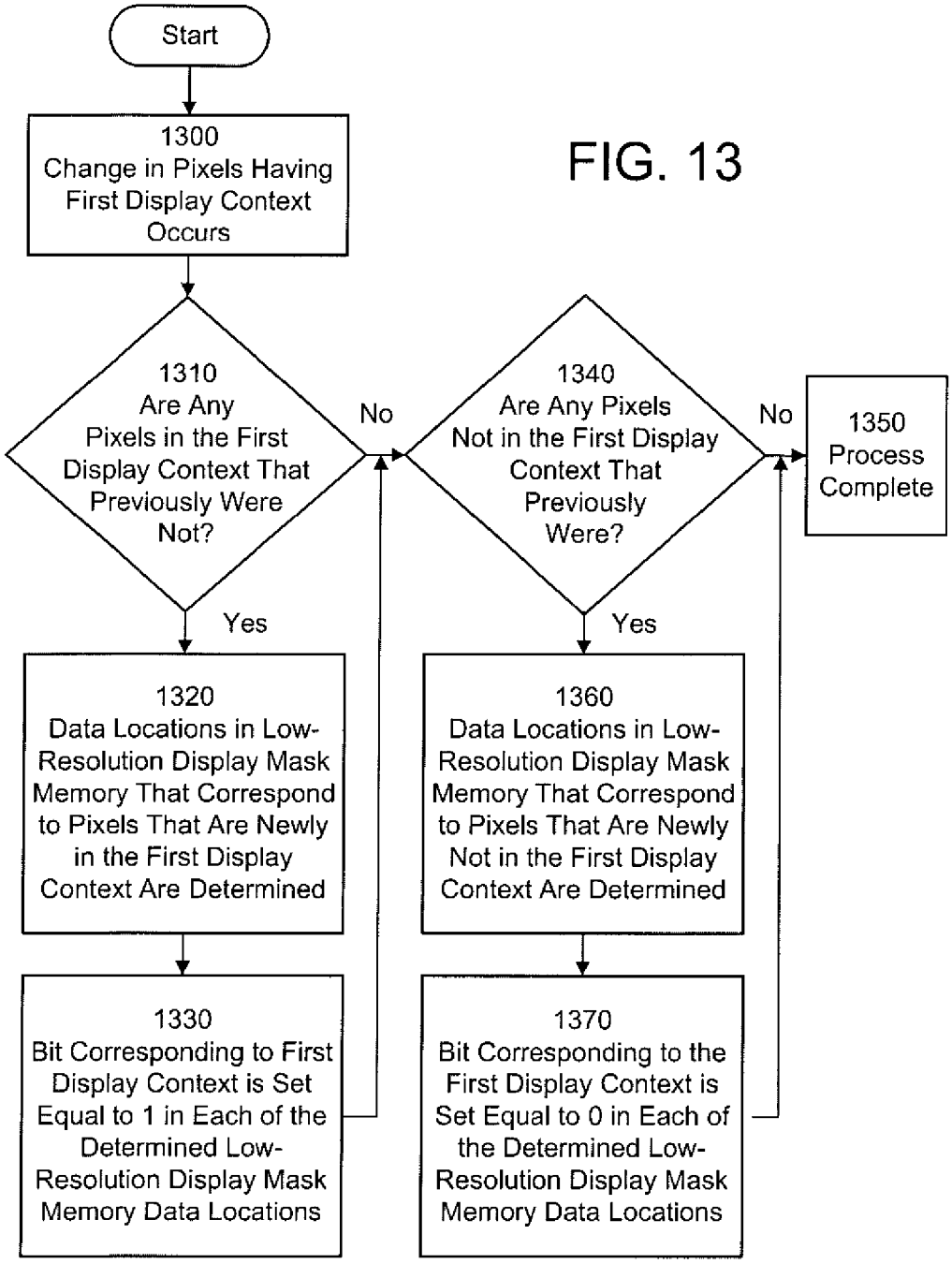
FIG. 13 is a flow diagram of the manipulation of low-resolution mask memory in accordance with another embodiment of the present invention.

FIG. 13 illustrates manipulation of low-resolution mask memory in accordance with another embodiment of the present invention. At block 1300, a change in the pixels having a first display context occurs. This change may be the result of the window associated with the first display context moving or being resized, or the change may be the result of another window moving in front of it. As a result, some pixels that previously were not in the first display context will now be in the first display context, and/or some pixels that previously were in the first display context will no longer be in the first display context.

At block 1310, it is determined whether any pixels are in the first display context that previously were not. If some pixel is in the first display context that previously was not, at block 1320, the data locations in low-resolution display mask memory that correspond to the pixels that are newly in the first display context are determined. At block 1330, the bit corresponding to the first display context is set equal to 1 in each of the determined low-resolution display mask memory data locations and the process continues at block 1340.

If at block 1310, no pixels are in the first display context that previously were not, at block 1340, it is determined whether any pixels are not in the first display context that previously were. If no pixels are not in the first display context that previously were, at block 1350, the process is complete. If a pixel is not in the first display context that previously was, at block 1360, the data locations in low-resolution display mask memory that correspond to the pixels that are newly not in the first display context are determined. At block 1370, the bit corresponding to the first display context is set equal to 0 in each of the determined low-resolution display mask memory data locations and the process continues at block 1350.

Multiple Low-Resolution Mask Memories

In one embodiment, more than one low-resolution mask memories are used. Each low-resolution mask memory has a different resolution level. For example, in one embodiment, the number of pixels in the display memory covered by a single location in the first low-resolution mask memory, second low-resolution mask memory and third low-resolution mask memory are 16, 64 and 256, respectively. In one embodiment, every pixel in the display memory is covered by a single location in a low-resolution mask memory.

Figure 14:
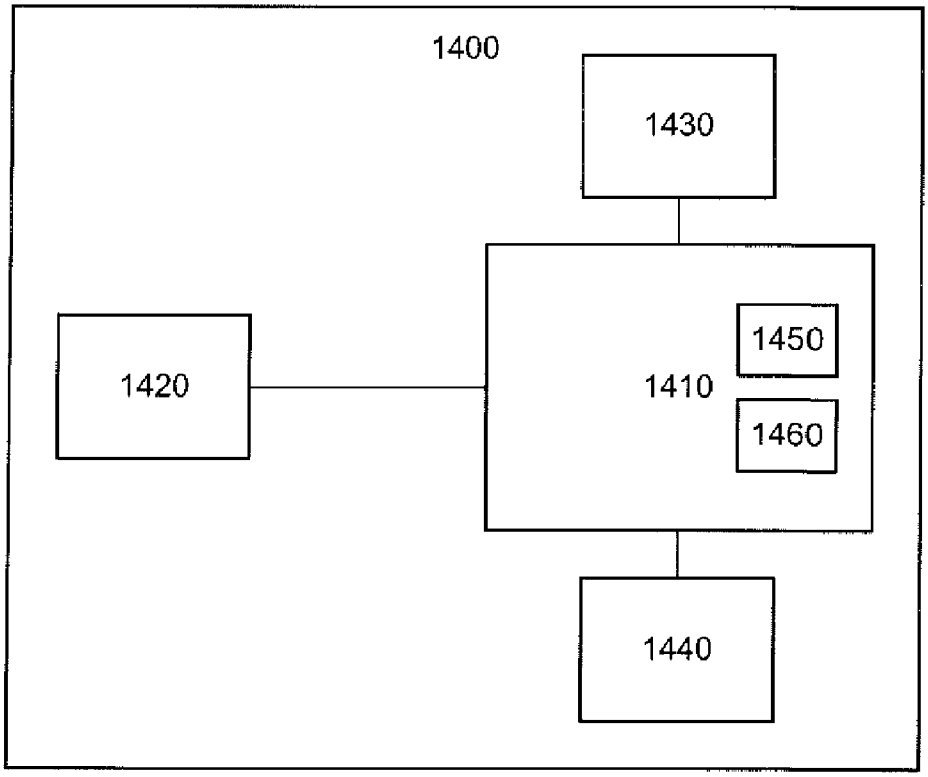
FIG. 14 is a block diagram of a display system with three low-resolution mask memories and a display mask memory in accordance with one embodiment of the present invention.

FIG. 14 illustrates a display system with three low-resolution mask memories and a display mask memory in accordance with one embodiment of the present invention. The display system 1400 has a graphics processor chip 1410 which is coupled to a display memory 1420, display mask memory 1430, low-resolution display mask memory 1440, lower-resolution display mask memory 1450 and lowest-resolution display mask memory 1460. Display memory 1420, display mask memory 1430 and low-resolution display mask memory 1440 are all on their own separate chip. Lower-resolution display mask memory 1450 and lowest-resolution display mask memory 1460 are both on the graphics processor chip 1410.

Each data location in display mask memory corresponds to a single pixel in display memory. Each data location in low-resolution display mask memory 1440 covers 16 pixels in the display memory. Similarly, each data location in lower-resolution display mask memory 1450 covers 64 pixels in the display memory. Likewise, each data location in lowest-resolution display mask memory 1460 covers 256 pixels in the display memory.

Virtual Desktop System Architecture

Figure 15:
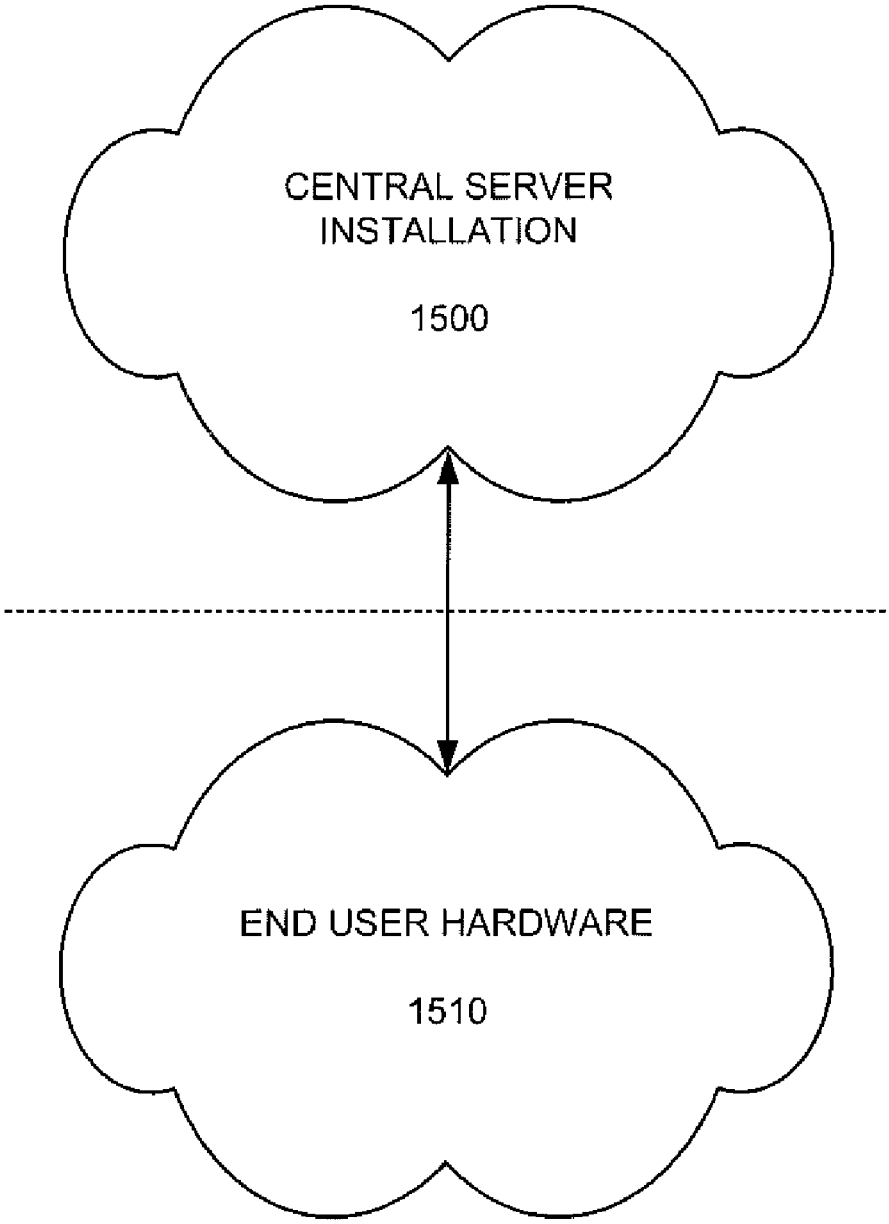
FIG. 15 is a block diagram of an example of a thin client topology called a virtual desktop system architecture in accordance with one embodiment of the present invention.

One embodiment of the invention is used as part of a thin client architecture system. FIG. 15 shows an example of a thin client topology called a virtual desktop system architecture. The virtual desktop system architecture provides a re-partitioning of functionality between a central server installation 1500 and end user hardware 1510. Data and computational functionality are provided by data sources via a centralized processing arrangement. At the user end, all functionality is eliminated except that which generates output to the user (e.g., display and speakers), takes input from the user (e.g., mouse and keyboard) or other peripherals that the user may interact with (e.g., scanners, cameras, removable storage, etc.). All computing is done by the central data source and the computing is done independently of the destination of the data being generated. The output of the source is provided to a terminal, referred to here as a "Human Interface Device" (HID). The HID is capable of receiving the data and displaying the data.

Figure 16:
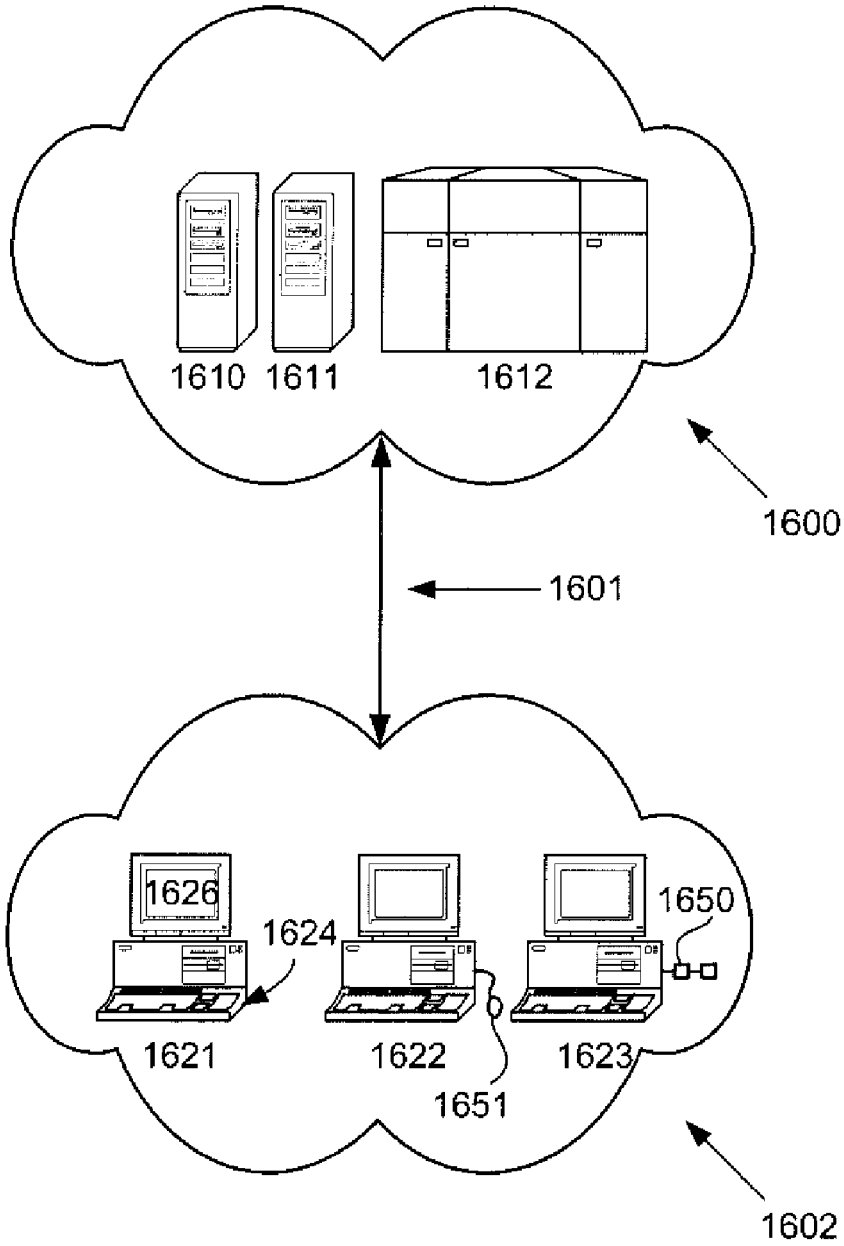
FIG. 16 is a block diagram of a system wherein one or more services communicate with one or more HIDs through a communication link such as network in accordance with one embodiment of the present invention.

The functionality of the virtual desktop system is partitioned between a display and input device such as a remote system and associated display device, and data sources or services such as a host system interconnected to the remote system via a communication link. The display and input device is a human interface device (HID). The system is partitioned such that state and computation functions have been removed from the HID and reside on data sources or services. One or more services communicate with one or more HIDs through a communication link such as network. An example of such a system is illustrated in FIG. 16, wherein the system comprises computational service providers 1600 communicating data through communication link 1601 to HIDs 1602.

The computational power and state maintenance are provided by the service providers or services. The services are not tied to a specific computer, but may be distributed over one or more traditional desktop systems such as described in connection with FIG. 16, or with traditional servers. One computer may have one or more services, or a service may be implemented by one or more computers. The service provides computation, state and data to HIDs and the service is under the control of a common authority or manager. In FIG. 16, the services are provided by computers 1610, 1611, and 1612. In addition to the services, a central data source can provide data to the HIDs from an external source such as for example the Internet or world wide web. The data source can also be broadcast entities such as those that broadcast data (e.g., television and radio signals).

Examples of services include X11/Unix services, archived or live audio or video services, Windows NT service, Java™ program execution service and others. A service herein is a process that provides output data and response to user requests and input. The service handles communication with an HID currently used by a user to access the service. This includes taking the output from the computational service and converting it to a standard protocol for the HID. The data protocol conversion is handled by a middleware layer, such as the X11 server, the Microsoft Windows interface, video format transcoder, the OpenGL® interface, or a variant of the java.awt.graphics class within the service producer machine. The service machine handles the translation to and from a virtual desktop architecture wire protocol described further below.

Each service is provided by a computing device optimized for its performance. For example, an Enterprise class machine could be used to provide X11/Unix service, a Sun MediaCenter™ could be used to provide video service, a Hydra based NT machine could provide applet program execution services.

The service providing computer system can connect directly to the HIDs through the interconnect fabric. It is also possible for the service producer to be a proxy for another device providing the computational service, such as a database computer in a three-tier architecture, where the proxy computer might only generate queries and execute user interface code.

The interconnect fabric can comprise any of multiple suitable communication paths for carrying data between the services and the HIDs. In one embodiment the interconnect fabric is a local area network implemented as an Ethernet network. Any other local network may also be utilized. The invention also contemplates the use of wide area networks, the Internet, the world wide web, and others. The interconnect fabric may be implemented with a physical medium such as a wire or fiber optic cable, or it may be implemented in a wireless environment.

The interconnect fabric provides actively managed, low-latency, high-bandwidth communication between the HID and the services being accessed. One embodiment contemplates a single-level, switched network, with cooperative (as opposed to completing) network traffic. Dedicated or shared communications interconnects maybe used in the present invention.

The HID is the means by which users access the computational services provided by the services. FIG. 16 illustrates HIDs 1621, 1622 and 1623. Each HID comprises a display 1626, a keyboard 1624, mouse 1651, and audio speakers 1650. The HID includes the electronics need to interface these devices to the interconnection fabric and to transmit to and receive data from the services.

Figure 17:
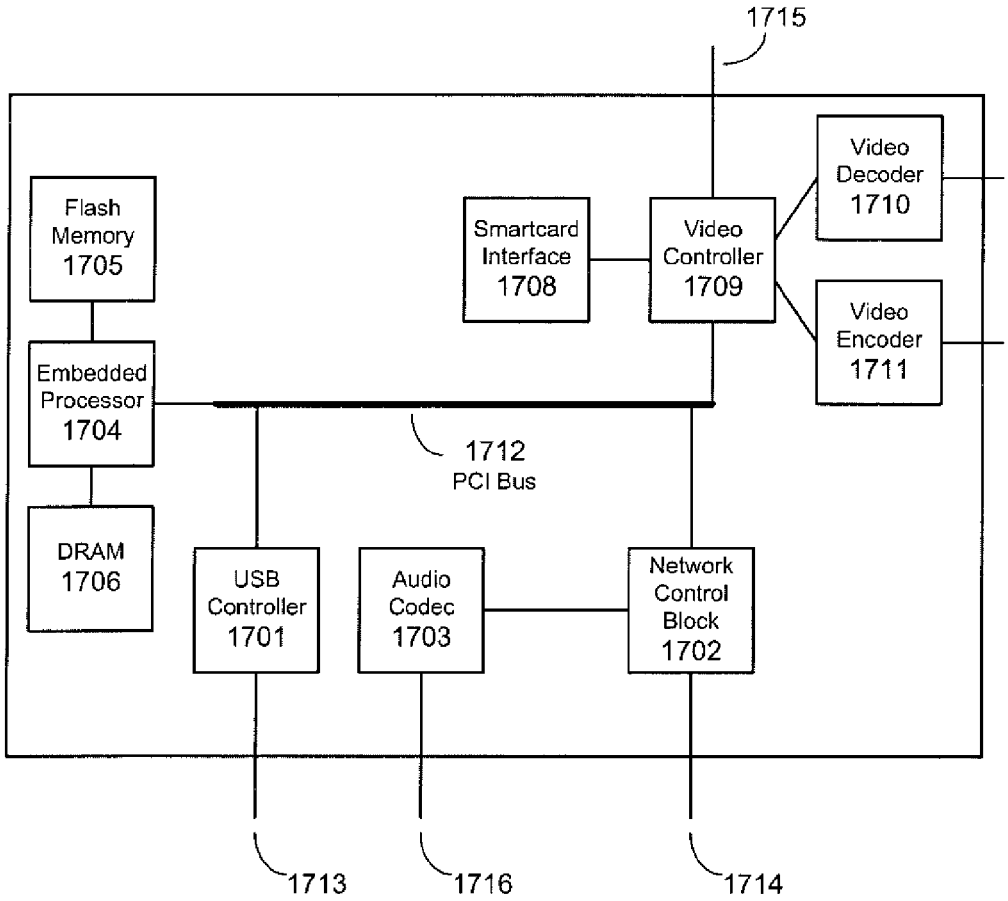
FIG. 17 is a block diagram of an example embodiment of the HID in accordance with one embodiment of the present invention.

A block diagram of an example embodiment of the HID is illustrated in FIG. 17. The components of the HID are coupled internally to a PCI bus 1712. Network control block 1702 communicates to the interconnect fabric, such as an Ethernet, through line 1714. An audio codec 1703 receives audio data on interface 1716 and is coupled to network control block 1702. USB data communication is provided on lines 1713 to a USB controller 1701. The HID further comprises a embedded processor 1704 such as a Sparc2ep with coupled flash memory 1705 and DRAM 1706. The USB controller 1701, the network control block 1702 and the embedded processor 1704 are all coupled to the PCI bus 1712. A video controller 1709, also coupled to the PCI bus 1712, can include an ATI RagePro+ frame buffer controller which provides SVGA output on the line 1715. NTSC data is provided in and out of the video controller through video decoder 1710 and encoder 1711 respectively. A smartcard interface 1708 may also be coupled to the video controller 1709.

Figure 18:
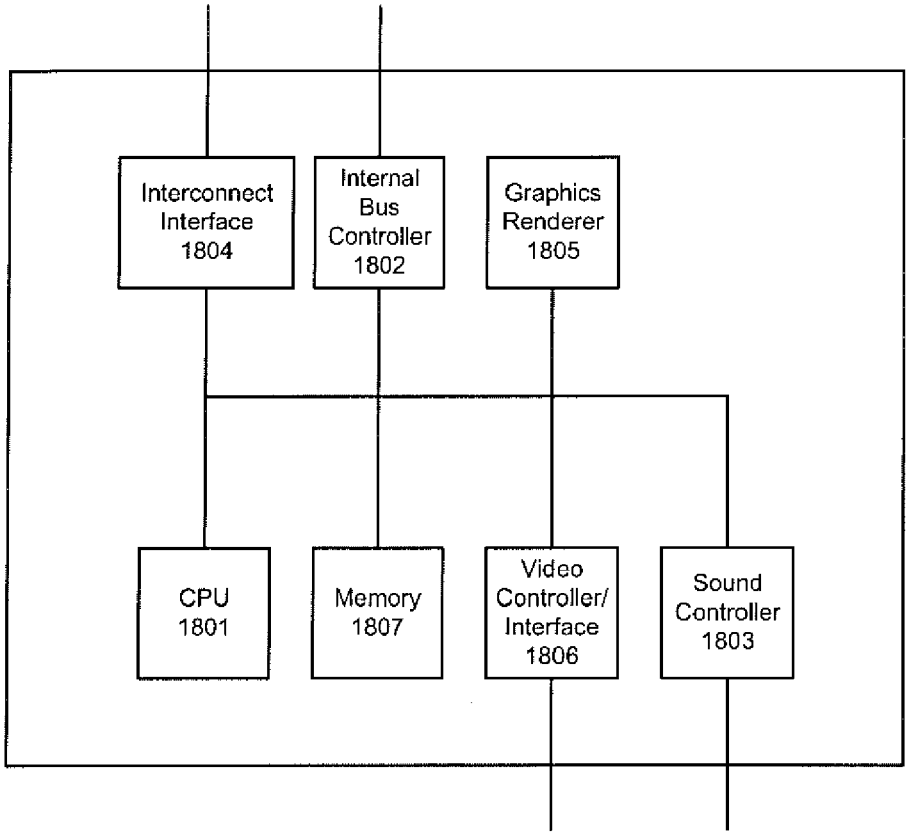
FIG. 18 is a block diagram of a single chip implementation of an HID in accordance with one embodiment of the present invention.

Alternatively, the HID can comprise a single chip implementation as illustrated in FIG. 18. The single chip includes the necessary processing capability implemented via CPU 1801 and graphics renderer 1805. Chip memory 1807 is provided, along with video controller/interface 1806. A internal bus (USB) controller 1802 is provided to permit communication to a mouse, keyboard and other local devices attached to the HID. A sound controller 1803 and interconnect interface 1804 are also provided. The video interface shares memory 1807 with the CPU 1801 and graphics renderer 1805. The software used in this embodiment may reside locally in on-volatile memory or it can be loaded through the interconnection interface when the device is powered.

Thus, a method and apparatus for hardware acceleration of display data clipping is described in conjunction with one or more specific embodiments. The invention is defined by the following claims and their full scope and equivalents.

The invention claimed is:

1. A method of display data clipping comprising:

obtaining first display information and second display information;

classifying display location data among a plurality of pixels for said first display information and said second display information in corresponding registers;

generating and displaying pixel map data from said first display information and said second display information on a display system having a plurality of pixels, with each of said plurality of pixels having pixel data associated therewith, said pixel map data corresponding to said pixel data;

issuing a display command for pixel data associated with one of said plurality of pixels; and examining multiple sets of said pixel map data in a sequence, with each successive set in the sequence corresponding to fewer pixels than a previous set to identify said one of said plurality of pixels.

2. The method of claim 1, wherein generating further includes storing said pixel map data among a plurality of memory locations, each of which contains pixel map data associated with multiple pixels of said plurality of pixels.

3. The method of claim 1, wherein generating further includes storing said pixel map data among a plurality of memory locations, each of which contains pixel map data associated with one of said plurality of pixels.

4. The method of claim 1 wherein generating further includes storing said pixel map data among a plurality of memory locations, a first set of said plurality of memory locations containing pixel map data associated with a first multiple of pixels of said plurality of pixels, a second set of said plurality of memory locations containing pixel map data associated with a second multiple of pixels of said plurality of pixels, and a third set of said plurality of memory locations containing pixel map data associated with a third multiple of pixels of said plurality of pixels, with said second multiple being greater than said first multiple and less than said third multiple.

5. The method of claim 1, wherein generating further includes storing said pixel map data among a plurality of memory locations, a first set of said plurality of memory locations containing pixel map data associated with a first multiple of pixels of said plurality of pixels, a second set of said plurality of memory locations containing pixel map data associated with a second multiple of pixels of said plurality of pixels, and a third set of said plurality of memory locations containing pixel map data associated with a third multiple of pixels of said plurality of pixels, with said second multiple being greater than said first multiple and less than said third multiple and examining further includes searching said third multiple before searching said second multiple and before searching said first multiple.

6. A display system comprising:

a display memory;

registers for classifying display location information associated with data transmitted to the display memory for a display having a plurality of pixels;

multiple memory locations, with each of the multiple memory locations of a first subgroup including information corresponding to a group of said plurality of pixels and each of the multiple memory locations of a second subgroup corresponding to each of said plurality of pixels;

circuitry to sequentially examine multiple sets of said multiple memory locations, with each successive set in the sequence corresponding to fewer pixels than a previous set to identify one of said plurality of pixels subject to a command; and circuitry to execute said command.

7. The display system of claim 6 wherein said second subgroup consists of a display mask memory, with said circuitry further including circuitry for determining a display context and a value for said one of said plurality of pixels.

8. The display system of claim 7, further comprising:

a graphics processor chip, wherein said display mask memory is in said graphics processor chip.

9. The display system of claim 7, further comprising:

a memory chip, wherein said display mask memory is in said memory chip.

10. The display system of claim 9, wherein said display memory is in said memory chip.

11. The display system of claim 6 wherein each of said plurality of pixels has a number of display contexts associated therewith and said first subgroup consists of a low-resolution display mask memory having a quantity of bits of memory equal to said number.

12. The display system of claim 11 wherein said display system further comprises:

a graphics processor chip, wherein said low-resolution display mask memory is in said graphics processor chip.

13. The display system of claim 11 wherein said display system further comprises:

a memory chip, wherein said low-resolution display mask memory is in said memory chip.

14. The display system of claim 13 wherein said display memory is in said memory chip.

15. The display system of claim 6 wherein said multiple memory locations further includes a third subgroup, with each of the multiple memory locations of said third including information corresponding an additional group of said, with a quantity of pixels associated with said group being greater than a number of pixels associated with said additional group.

16. The display system of claim 15 wherein each of said plurality of pixels has a number of display contexts associated therewith and said third subgroup consists of a low-resolution display mask memory having a quantity of bits of memory equal to said number.

17. The display system of claim 15 wherein said second subgroup consists of a display mask memory and said first subgroup consists of a first low-resolution display mask memory and said third subgroup consists of a second low-resolution display mask memory, with said circuitry further including circuitry for determining a display context and a value for said one of said plurality of pixels by first searching information associated with one of said first and second low-resolution display mask memories and then searching said display mask memory.

18. The display system of claim 6 further comprising a server located away from said display system.

19. The display system of claim 18 further comprising a thin client and wherein said display system is located on said thin client.

* * * * *